US009113730B2

(12) United States Patent
Perez

(10) Patent No.: US 9,113,730 B2
(45) Date of Patent: Aug. 25, 2015

(54) BED COVER WITH INTEGRATED ARTICLE OF CLOTHING

(71) Applicant: Franco Manufacturing Co. Inc., Metuchen, NJ (US)

(72) Inventor: Hugo Washington Perez, Ramsey, NJ (US)

(73) Assignee: Franco Manufacturing Co., Inc., Metuchen, NJ (US)

( * ) Notice: Subject to any disclaimer, the term of this patent is extended or adjusted under 35 U.S.C. 154(b) by 27 days.

(21) Appl. No.: 13/654,733

(22) Filed: Oct. 18, 2012

(65) Prior Publication Data

US 2013/0091630 A1 Apr. 18, 2013

Related U.S. Application Data

(60) Provisional application No. 61/548,243, filed on Oct. 18, 2011.

(51) Int. Cl.

| | |
|---|---|
| ***A47G 9/00*** | (2006.01) |
| ***A47G 9/02*** | (2006.01) |
| ***A41D 15/04*** | (2006.01) |

(52) U.S. Cl.

CPC *A47G 9/02* (2013.01); *A41D 15/04* (2013.01); *A47G 9/0207* (2013.01); *A47G 9/0223* (2013.01); *A47G 9/0238* (2013.01); *A47G 9/00* (2013.01)

(58) Field of Classification Search

CPC ..... A47G 9/00; A47G 9/0223; A47G 9/0238; A47G 9/0207; A47G 9/02

USPC ..... 5/669, 692, 482, 498, 499, 923, 502, 5/907

See application file for complete search history.

(56) References Cited

U.S. PATENT DOCUMENTS

| | | | | |
|---|---|---|---|---|
| 4,890,347 | A * | 1/1990 | Fuller | 5/658 |
| 5,540,609 | A * | 7/1996 | Hoag | 446/26 |
| 6,675,408 | B1 * | 1/2004 | Mason | 5/2.1 |
| 6,848,131 | B1 * | 2/2005 | Landry | 5/494 |
| 7,383,598 | B2 * | 6/2008 | Titcomb | 5/502 |
| 7,774,878 | B1 * | 8/2010 | Florea et al. | 5/627 |
| 8,020,226 | B2 * | 9/2011 | Landry | 5/494 |
| 8,191,188 | B2 * | 6/2012 | Kaplan et al. | 5/485 |
| 8,321,980 | B2 * | 12/2012 | Maloney | 5/655 |
| 2007/0017028 | A1 * | 1/2007 | Myers | 5/497 |
| 2009/0019639 | A1 * | 1/2009 | Cervino, III | 5/486 |
| 2009/0113630 | A1 * | 5/2009 | Landry | 5/494 |
| 2010/0186166 | A1 * | 7/2010 | Sulentic | 5/494 |
| 2011/0056021 | A1 * | 3/2011 | James | 5/502 |
| 2011/0061701 | A1 * | 3/2011 | Perez | 135/96 |
| 2012/0096642 | A1 * | 4/2012 | Hickman | 5/482 |
| 2012/0216349 | A1 * | 8/2012 | Kaplan et al. | 5/494 |

* cited by examiner

*Primary Examiner* — Peter M Cuomo
*Assistant Examiner* — David E Sosnowski
(74) *Attorney, Agent, or Firm* — Maldjian Law Group LLC

(57) ABSTRACT

An integrated bedding cover system includes a article of clothing and a bed cover. The integrated bedding cover system further includes a fastening means to attach the article of clothing with the bed cover. In one embodiment, the article of clothing includes a plurality of male snaps and a plurality of female snaps, and the bed cover includes a plurality of male snaps and a plurality of female snaps. The male snaps of the article of clothing are configured to engage with the female snaps of the bed cover, and the female snaps of the article of clothing are configured to engage with the male snaps of the bed cover to attach the article of clothing with the comforter. The integrated bedding cover system provides a theme that matches with a particular theme coordinated with a child's bedroom furniture, window treatments, and color schemes.

13 Claims, 12 Drawing Sheets

500

BED COVER WITH INTEGRATED ARTICLE OF CLOTHING

CROSS-REFERENCE TO RELATED APPLICATIONS

This application claims the benefit of U.S. Provisional Application Ser. No. 61/548,243, filed Oct. 18, 2011, entitled "BED COVER WITH INTEGRATED ARTICLE OF CLOTHING," which is incorporated herein by reference in its entirety.

BACKGROUND

1. Field of the Invention

Embodiments of the present invention generally relate to bed covers and particularly to a bed cover with an integrated article of clothing.

2. Description of Related Art

Children, and their parents, enjoy bedding material with certain themes that they can coordinate with a child's bedroom furniture, window treatments, color schemes, and the like. For example, there are car themes, princess themes, animal character themes, and the like. Some character themes include cartoon heroes and villains, movie princesses and princes, as well as other appealing make-believe themes. In certain instances, the main character is so beloved by the children, the children want to be that character or at least roll play that character for a time period. Often times, children in their freewheeling imagination, want to dress up in their favorite characters' clothing during roll play or story time.

Conventional solutions require parents to purchase separate clothing for the child to wear that has a common theme to the already purchased bedding and accessories. But sometimes, the character apparel is not exactly like the rest of the child's bedroom bedding, and accessories. Or worse yet, the character apparel may be unavailable, much to the chagrin of the child and the angst of the parents or guardian. Furthermore, even if the character apparel is available for purchase, once acquired, it may get lost. Significantly, the character apparel will not be available for a spontaneous roll play or story time. And anyone who has reared children will know how important spontaneity is to them.

In addition, the character apparel, when purchased and used separately, will be stored in a closet or clothes drawer and not be part of the actual theme bedroom and furniture. It is very likely that in these given scenarios, the apparel will not even be used as intended.

Thus, there is a need for a coordinated or integrated bed cover with at least one integrated article of coordinating clothing detachably attached thereto to allow for substantially spontaneous roll playing, story time, or the like, where a child (or adult for that matter) can have a complete character immersing experience.

SUMMARY

Embodiments in accordance with the present invention provide an integrated bedding cover system. The integrated bedding cover system includes a bed cover and an article of clothing. The integrated bedding cover system further includes a fastening means to attach the article of clothing with the bed cover. In one embodiment, the article of clothing includes a plurality of male snaps and a plurality of female snaps, and the bed cover also includes a plurality of male snaps and a plurality of female snaps. The male snaps of the article of clothing are configured to engage with the female snaps of the bed cover and the female snaps of the article of clothing are configured to engage with the male snaps of the bed cover to attach the article of clothing with the comforter.

Embodiments in accordance with the present invention further provide a method of integrating an article of clothing with a bed cover. The method includes attaching fastening means to an article of clothing. The method further includes attaching fastening means to a bed cover. The method further includes engaging the fastening means of the article of clothing with the fastening means of the bed cover to attach the article of clothing with the bed cover.

Embodiments of the present invention can provide a number of advantages depending on the particular configuration. Embodiments of the present invention provide an integrated bedding cover system. The integrated bedding cover system provides a theme that may match with a particular theme coordinated with a child's bedroom furniture, window treatments, color schemes, and the like. Hence, embodiments of the present invention provide a novel and innovative way for a child to decorate his or her bedding, e.g., comforter with apparel of his or her favorite character and also engage in roll playing and story-telling by detaching and wearing the apparel. This would substantially help the child develop imagination, creativity and learning.

Further, embodiments of the present invention advantageously provide an integrated bedding cover system. Hence, there is no need to store the bedding cover and the article of clothing or other attachment in different places. Also, there is no need to search for the article of clothing or other attachment in case of a requirement. Hence, embodiments of the present invention facilitate reducing time and effort of a user to locate an article of clothing or attachment of immediate use nearby beds. The dress/other articles of clothing are already attached to the bedding cover and may be utilized immediately in case of a requirement.

These and other advantages will be apparent from the disclosure of embodiments of the present invention contained herein.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted the terms "comprising", "including", and "having" can be used interchangeably.

The word "dress" is meant to describe one aspect or embodiment of the present invention and is contemplated as a specific example of an article of clothing.

The preceding is a simplified summary of the present invention to provide an understanding of some aspects. This summary is neither an extensive nor exhaustive overview of the present invention and its various embodiments. It is intended neither to identify key or critical elements of the present invention nor to delineate the scope of the present invention but to present selected concepts of the present invention in a simplified form as an introduction to the more detailed description presented below. As will be appreciated, other embodiments of the present invention are possible utilizing, alone or in combination, one or more of the features set forth above or described in detail below.

BRIEF DESCRIPTION OF THE DRAWINGS

The above and still further features and advantages of the present invention will become apparent upon consideration of the following detailed description of embodiments thereof, especially when taken in conjunction with the accompanying drawings, wherein like reference numerals in the various figures are utilized to designate like components, and wherein.

Figure 1A:
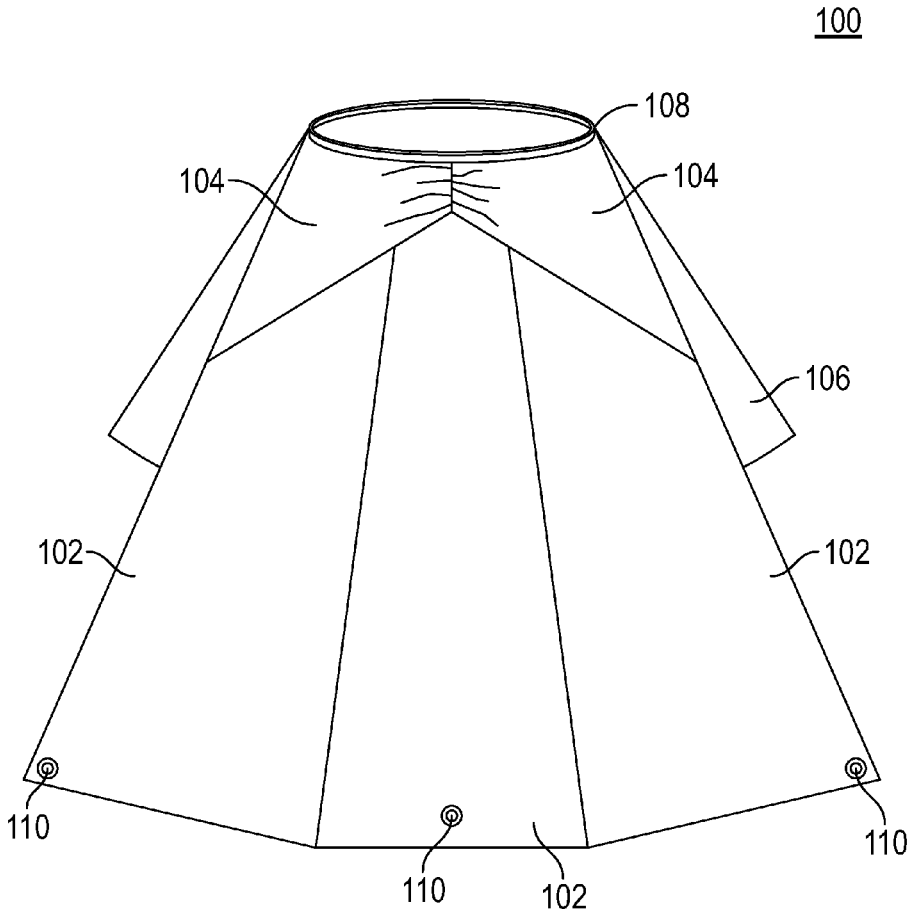
FIG. 1A depicts the front of a thematic sheer fabric dress with elastic waist, capable of being integrated with a bedding cover according to an embodiment of the present invention.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures. Optional portions of the figures may be illustrated using dashed or dotted lines, unless the context of usage indicates otherwise.

DETAILED DESCRIPTION

Embodiments of the invention will be illustrated below in conjunction with an integrated bedding cover system. Although well suited for use with any dress, e.g., child's dress, adult's dress, etc., and any bed cover, e.g., bed cover, blanket, quilt, etc., the invention is not limited to any particular type of dress or dress for that matter, and bed cover. Those skilled in the art will recognize that the disclosed techniques may be used with any dress or other article of clothing that is desirable to attach with a bed cover. Therefore, when embodiments of the present invention describe a "dress", it is contemplated to be describing any article of clothing that may be attachable to a bed covering such as a cowboy outfit, race car jumper, cheerleader outfit, cartoon character outfit and the like (collectively described herein as a "dress").

Figure 1B:
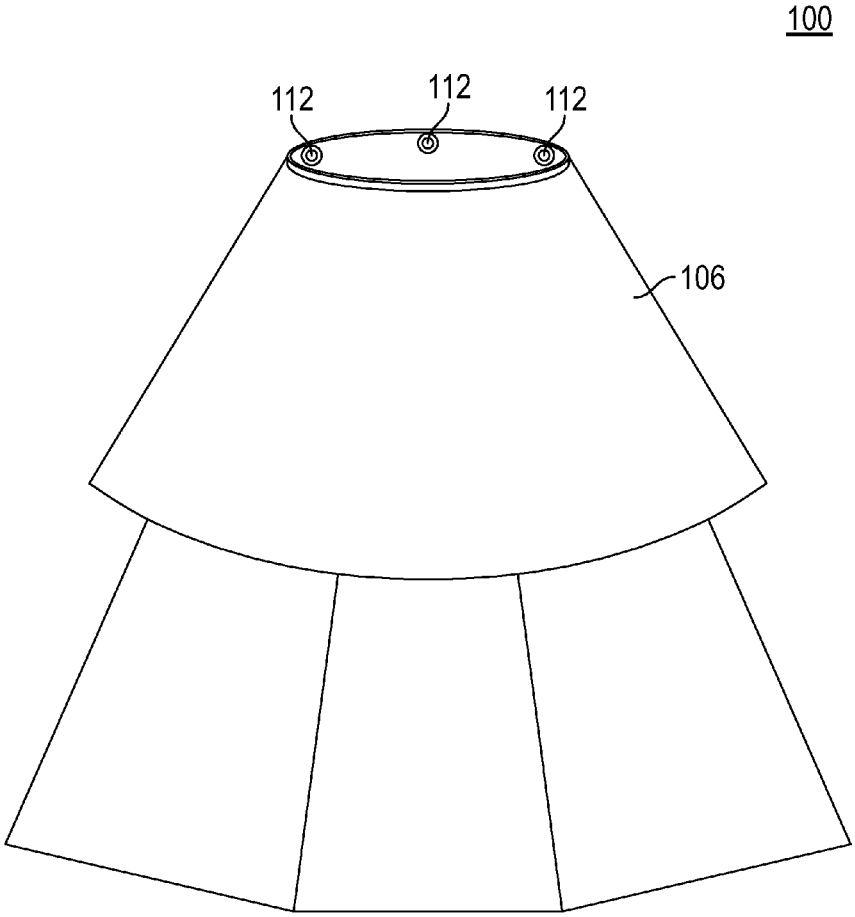
FIG. 1B depicts the back of the dress, according to an embodiment of the present invention.

FIGS. 1A and 1B illustrate front and back of a dress 100, capable of being integrated with a bed cover according to an embodiment of the present invention. In one embodiment, the dress 100 is a thematic sheer fabric skirt. In another embodiment, the dress 100 may be any dress suitable to be worn by a child. In yet another embodiment, the dress 100 may be any dress suitable to be worn by an adult. Further, in an embodiment, the dress 100 includes six panels of sheer fabric. In another embodiment, the dress 100 may include any other number of panels of sheer fabric. The six panels may include first panel, second panel, third panel, a fourth panel, a fifth panel, and a sixth panel. The first panel, the second panel, and the third panel are of similar size and shape, and form front panels 102 of the dress 100. The first panel, the second panel, and the third panel may be sewn together to make the front panel 102 of the dress 100.

Further, two side panels may be attached on the top portion of the front panels 102. The fourth panel and the fifth panel are of similar size and shape, and form side panels 104 of the dress 100. The size of the side panels 104 is smaller than size of the front panels 102, as shown in the figure. Further, in an embodiment, the side panels 104 may make peplums of the dress 100.

Next, sixth panel 106 from the six panels may form back panel of the dress 100. The sixth panel 106 may be used to make the back of the dress 100. The size of the back panel 106 may be different than the front panels 102 and the side panels 104. In an embodiment, the size of the back panel 106 is greater than the side panels 104, but lesser than the front panels 102. Further, the front panels 102, the side panels 104, and the back panel 110 may be sewn together to make the dress 100.

Further, the dress 100 may include an elastic waist 108, as shown in the FIG. 1. The elastic waist 108 is added to form the waist line of the dress/skirt for the wearer. Those skilled in the art will appreciate that the elastic waist 108 may be used for quickly and easily wearing the dress by a child or adult.

Further, the dress 100 includes fastening means 110 according to an embodiment of the present invention, as shown in FIG. 1A. In one embodiment, the fastening means 110 include a plurality of male snaps (for example, three male snaps) at lower end of the front panel 102. The snaps may be plastic snaps or metallic snaps. In another embodiment, the fastening means 110 may be hook and loop fasteners. In yet another embodiment, the fastening means 110 may include any other fastening mechanism, for example, adhesive strap.

Further, according to an embodiment of the present invention, the inside of the waist 108 may also include fastening means 112. In one embodiment, the fastening means 112 may include a plurality of female plastic snaps (for example, three female snaps). In another embodiment, the fastening means 110 may include any other fastening mechanism. Further, in one embodiment, the dress 100 may include either fastening means 108 or fastening means 110. In another embodiment, the dress 100 may include both of the fastening means 108 and the fastening means 110. It is also contemplated that there may be more than one dress attachable to the bedding. For example, there may be a mother/daughter theme to the bedding and both the mother and the daughter desire to play "dress up."

Figure 2:
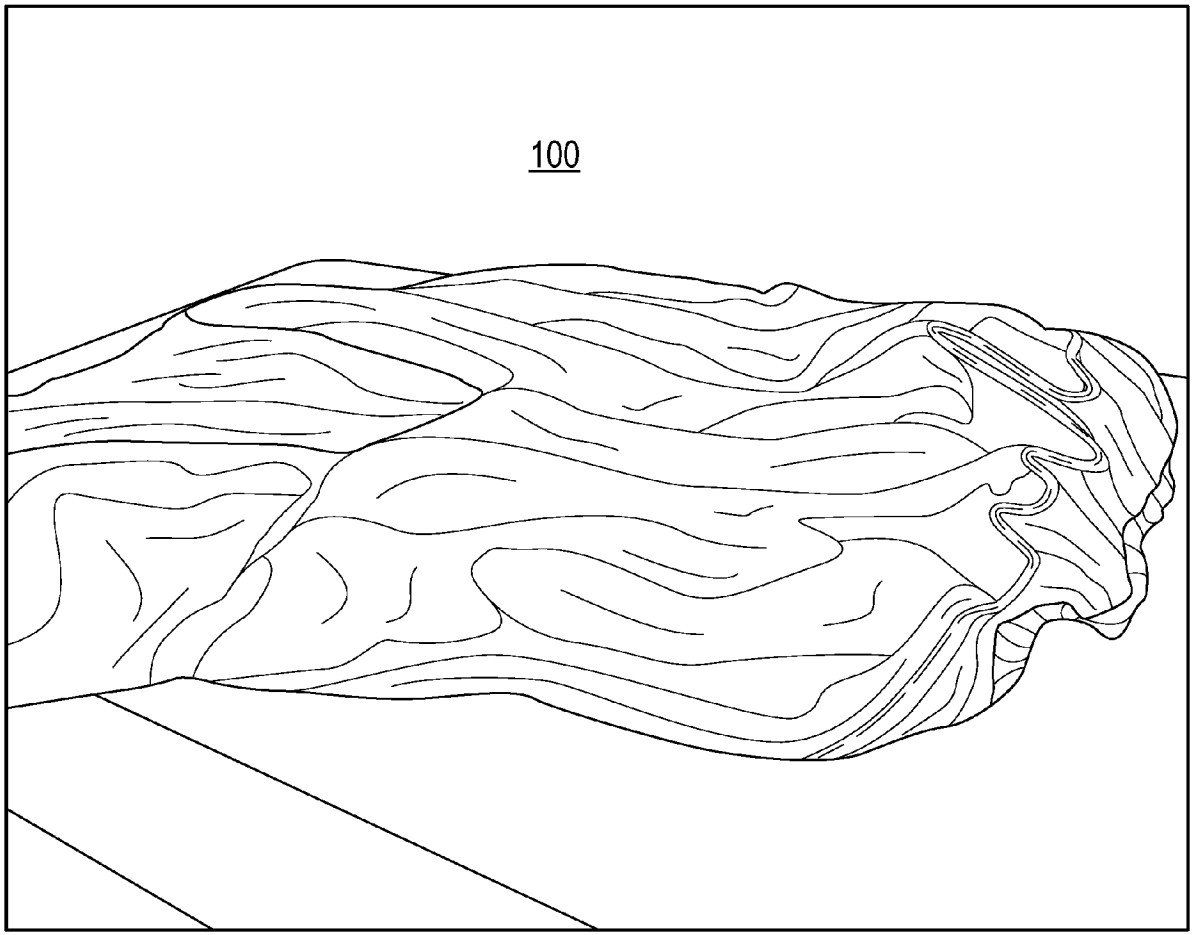
FIGS. 2 and 3 depict perspective side views of the sheer fabric dress during assembly in accordance with an embodiment of the present invention.
Figure 3:
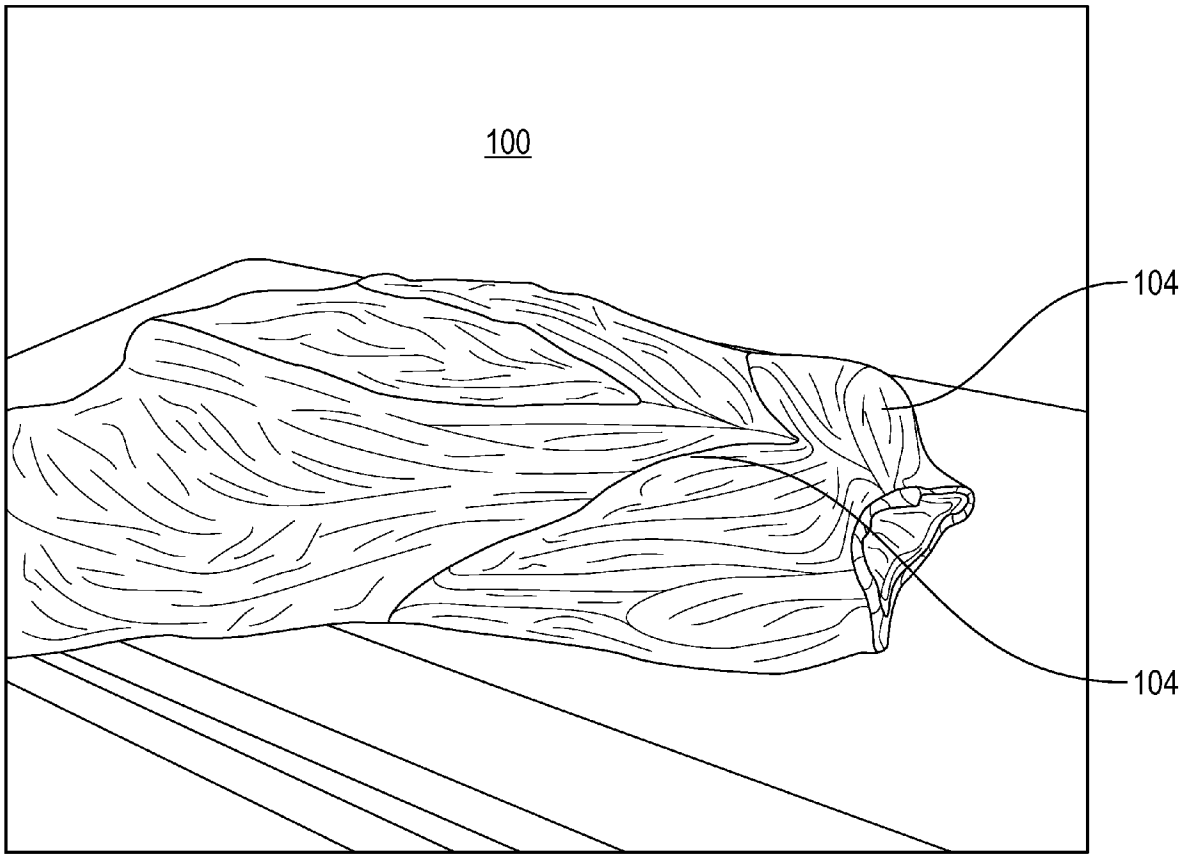

FIGS. 2 and 3 depict perspective views of the dress 100 of one embodiment of the present invention as the dress is being assembled, including adding the additional elastic for the waist. FIG. 2 shows front panels 102. FIG. 3 shows side panels 104 and elastic waist 108 added to the front panels 102 of the dress 100. The dress 100 may include dress of cartoon heroes and villains, movie princesses and princes, as well as other appealing make-believe characters beloved by a user or child.

Figure 4:
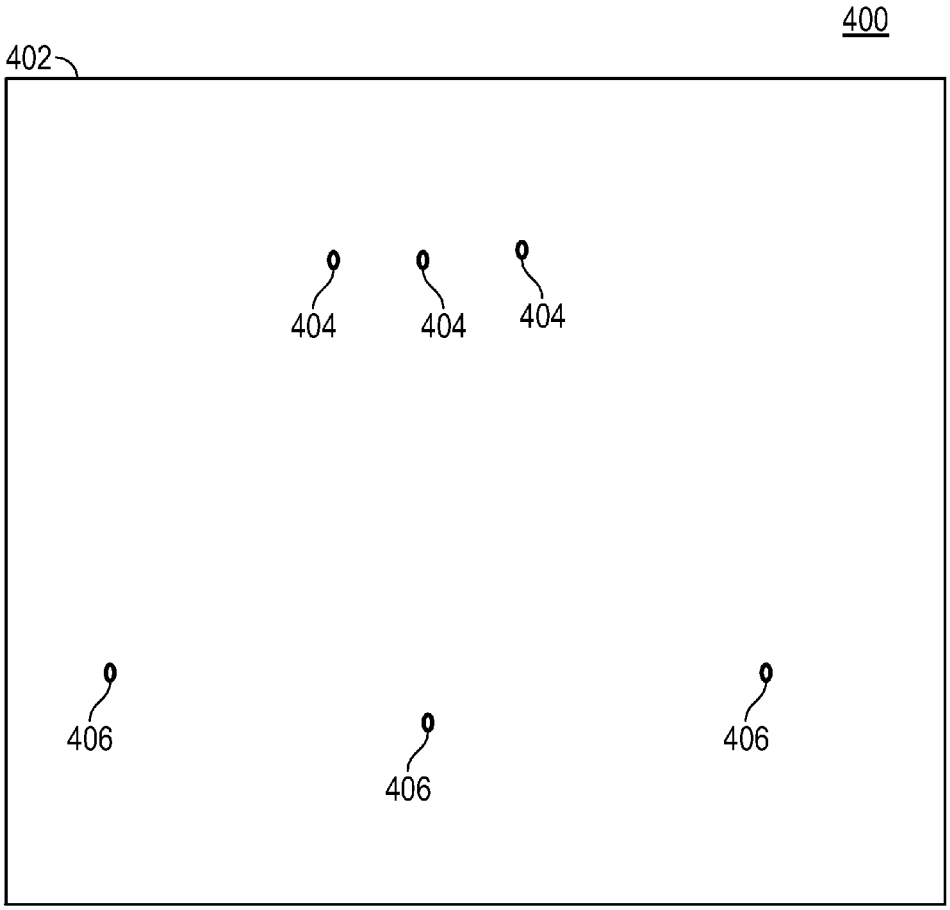
FIG. 4 depicts a snapped bed cover, according to an embodiment of the present invention.

FIG. 4 shows an illustrative embodiment of a snapped bed cover 400, according to an embodiment of the present invention. The snapped bed cover 400 includes a bed cover 402. The bed cover 402 is a cover that may be used at bed, for example, a comforter, a blanket, a quilt etc. The snapped bed cover 400 further includes fastening means 404. In an embodiment, the fastening means 404 may include a plurality of male snaps buttons (for example, three male snaps). In another embodiment, the fastening means 404 may include any other fastening mechanism. Further, in an embodiment, the snapped bed cover 404 may further include fastening means 206. Further, in an embodiment, the fastening means 406 may include a plurality of female snap buttons (for example, three female snaps buttons). In another embodiment, the fastening means 406 may include any other fastening mechanism. Further, in an embodiment, the snapped bed cover 400 may include fastening means 404 or the fastening means 406. In another embodiment, the snapped bed cover 400 may include both of the fastening means 404 and the fastening means 406. Further, in an embodiment, the snapped bed cover 400 may include the three male and three female snaps matching the position of the male and female snaps of the dress 100.

Further, the snapped bed cover 400 may have a particular theme coordinated with a child's bedroom furniture, window treatments, color schemes, and the like. In one embodiment, the theme may include car themes, princess themes, animal character themes, or the like. Further, in an embodiment, the theme may include cartoon heroes and villains, movie princesses and princes, as well as other appealing make-believe themes.

Figure 5:
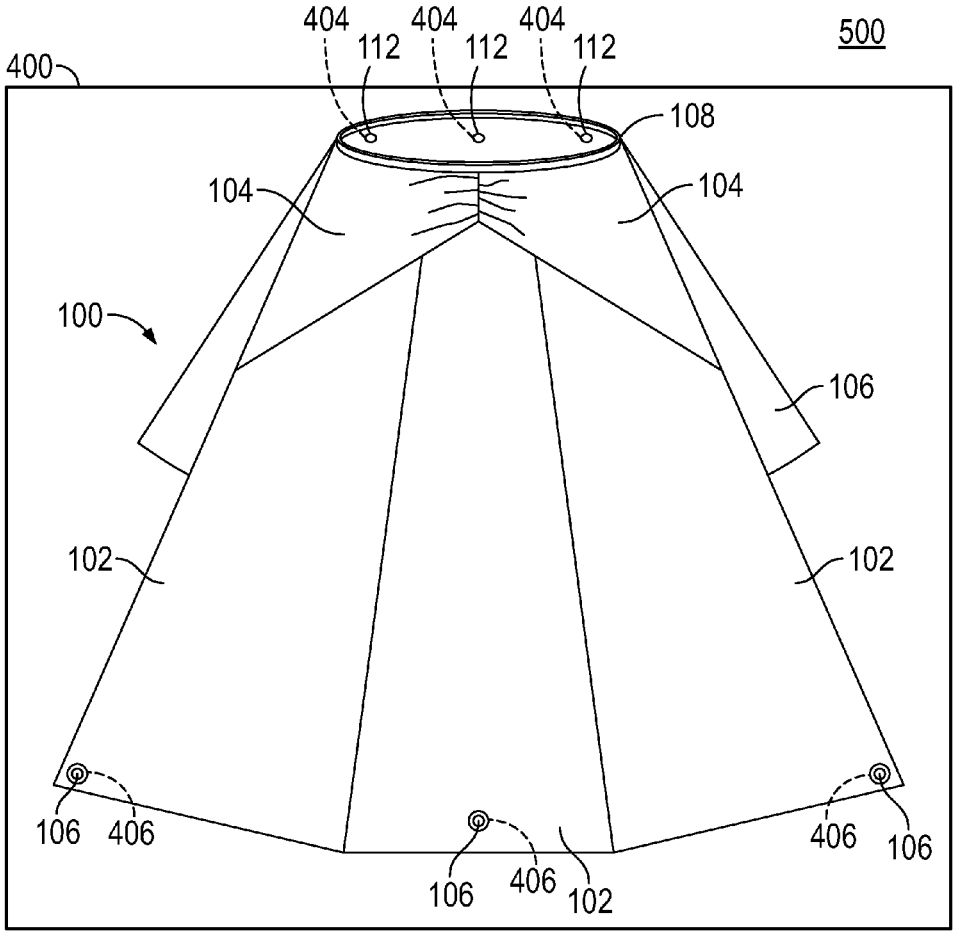
FIG. 5 depicts the dress integrated with the snapped bed cover depicting an embodiment of the invention.

FIG. 5 shows an illustrative embodiment an integrated bedding cover system 500, according to an embodiment of the present invention. As shown in the figure, the dress 100 has been integrated with the snapped bed cover 400 to form the integrated bedding cover system 500. The integrated bedding cover system 500 includes the bed cover 400 and the dress 100.

Further, according to an embodiment of the present invention, male snaps 404 of the snapped bed cover 400 may be engaged with the female snaps 112 of the dress 100 to attach and/or fasten the dress 100 to the snapped bed cover 400 to form the integrated bedding cover system 500. Further, female snaps 406 of the snapped bed cover 400 may be engaged with the male snaps 110 of the dress 100 to secure the dress 100 to the snapped bed cover 400 to form the integrated bedding cover system. In another embodiment, any other fastening mechanism may be used to attach/secure the dress 100 to the snapped bed cover 400.

Further, the dress 100 is attached to the snapped bed cover 400 in a removable manner. In this particular embodiment, the dress 100 is attached to the snapped bed cover 400 by four plastic snaps. Further, the dress 100 can be detachably attached and removed from the snapped bed cover 400 and be worn by a child as a character's costume during roll play or story time or any other time.

Further, the theme of the dress 100 may match with the theme of the snapped bed cover 400. Further, the theme of the integrated bedding cover system 500 may match with a particular theme coordinated with a child's bedroom furniture, window treatments, color schemes, and the like. In one embodiment, the theme may include car themes, princess themes, animal character themes, or the like. Further, in an embodiment, the theme may include cartoon heroes and villains, movie princesses and princes, as well as other appealing make-believe themes.

Figure 6:
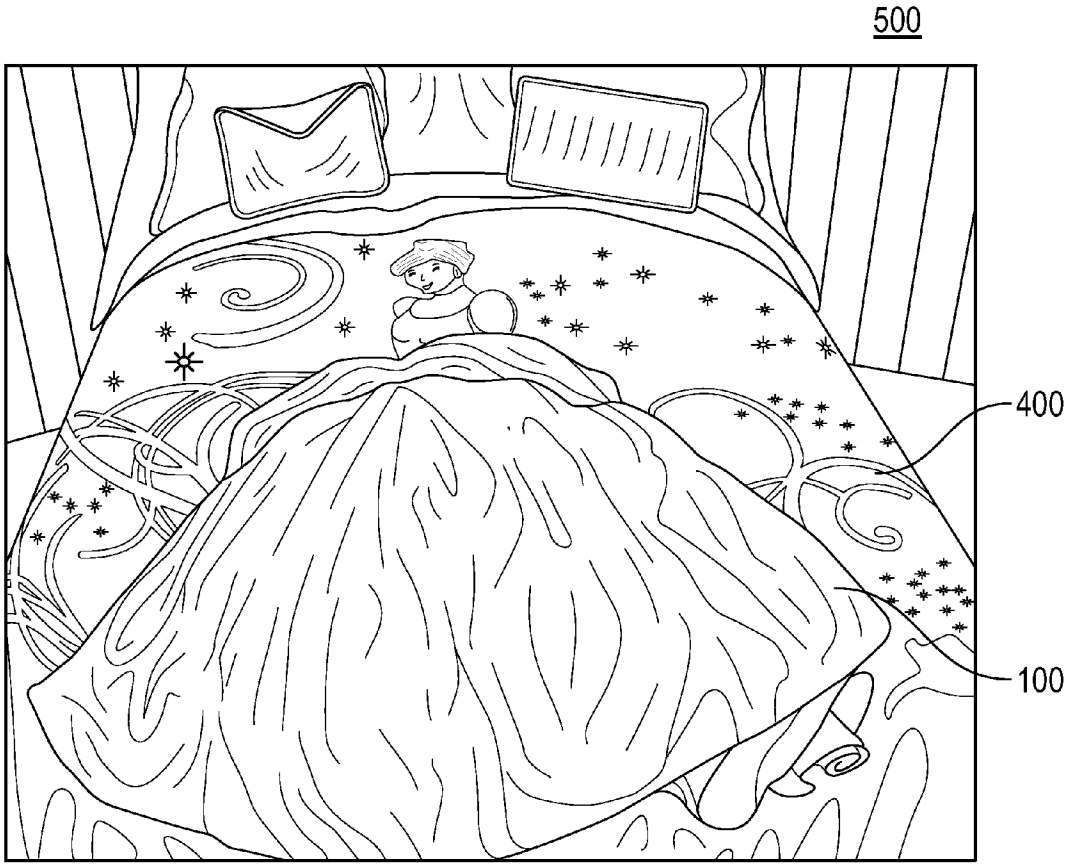
FIG. 6 depicts the top perspective view of the integrated bed cover with the thematic sheer fabric dress integrated with the snapped bed cover.
Figure 7:
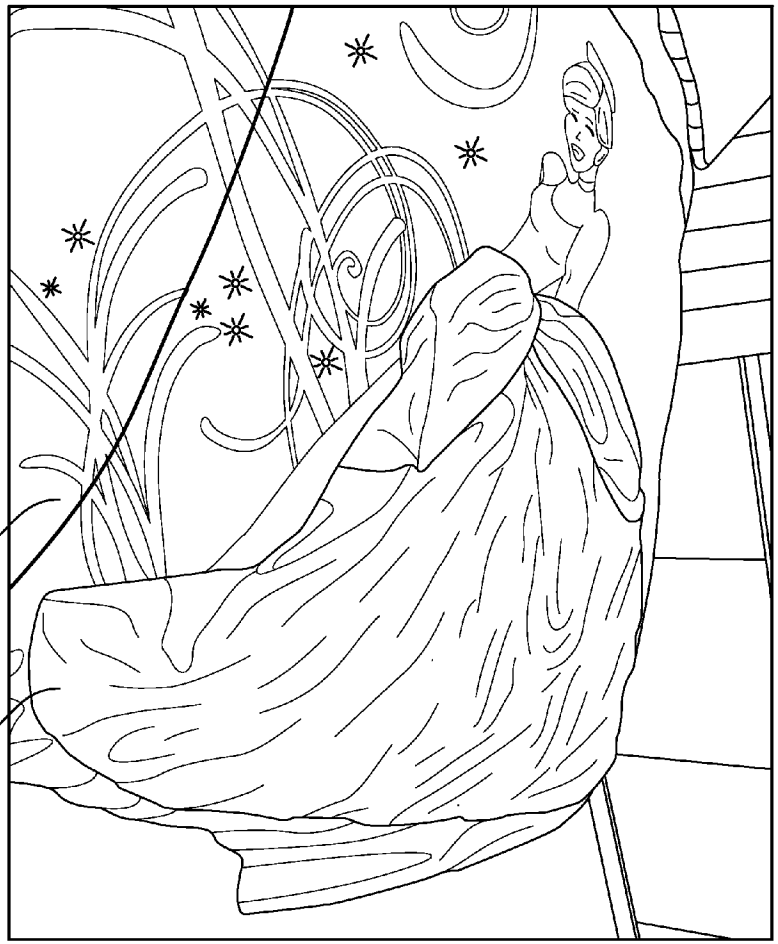
FIG. 7 depicts a side perspective view of the integrated bed cover with the thematic sheer fabric dress integrated with the snapped bed cover.

FIGS. 6 and 7 depict perspective views of an embodiment of the present invention, where the dress 100 is that of a famous princess. In another embodiment, the dress may be of some cartoon character or some movie character beloved by the child or hero/protagonist of the story told to the child. In one embodiment, the dress 100 is a skirt that is wearable and coordinated apparel. As shown in the figure, the snapped bed cover 400 is coordinated with the removable dress 100.

The dress 100 may be detachably attached to the snapped bed cover 400 by engaging the fastening means of the dress with the fastening means of the bed cover. For example, the fastening means 110 and 112 of the dress may be engaged with the fastening means 404 and 406 of the snapped bed cover 400 to secure the dress 100 with the snapped bed cover 400. Further, in an embodiment, the fastening means may include an adhesive strap (not shown in the figure), hook or loop (not shown in the figure) to attach/secure the dress 100 with the snapped bed cover 400.

The dress 100 may be left attached to the snapped bed cover 400 until the requirement. Whenever required, for example, during story telling at night or afternoon or some other time of the day, the dress 100 may be removed from the snapped bed cover 400 by disengaging the fastening means of the dress from the fastening means of the bed cover. For example, the fastening means 110 and 112 of the dress may be disengaged with the fastening means 404 and 406 of the snapped bed cover 400 to remove the dress 100 from the snapped bed cover 400. The dress 100 may then be utilized by the user (for example, child).

Figure 8:
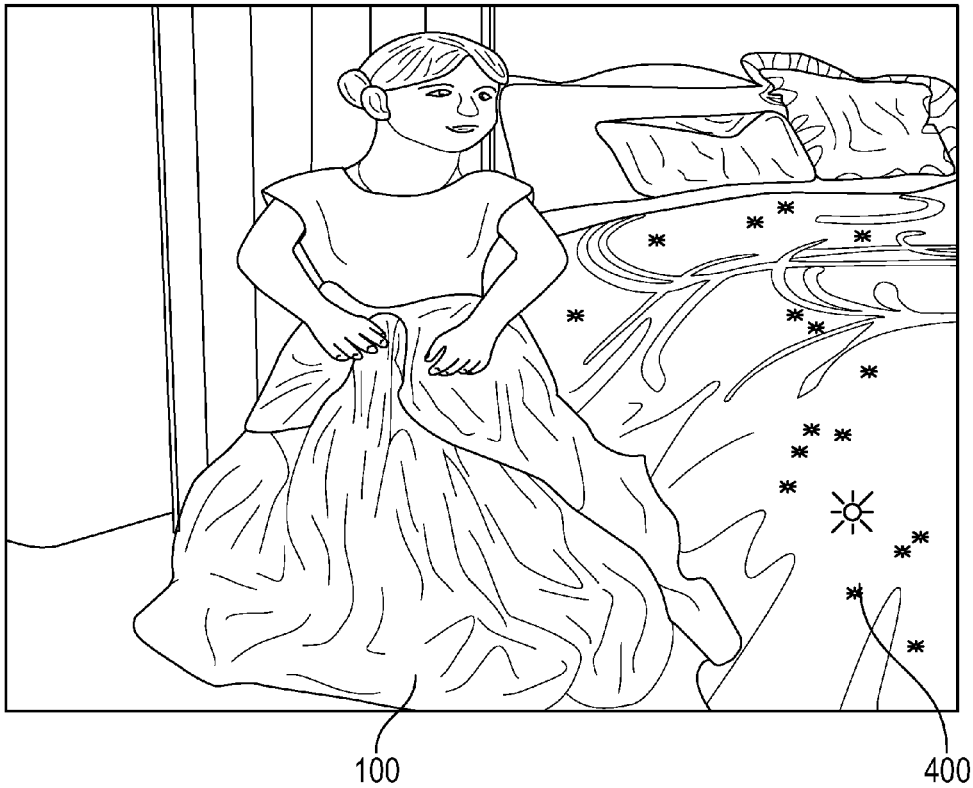
FIGS. 8 and 9 depict a mannequin modeling the sheer fabric dress in use after being detached from the snapped bed cover in accordance with an embodiment of present invention.
Figure 9:
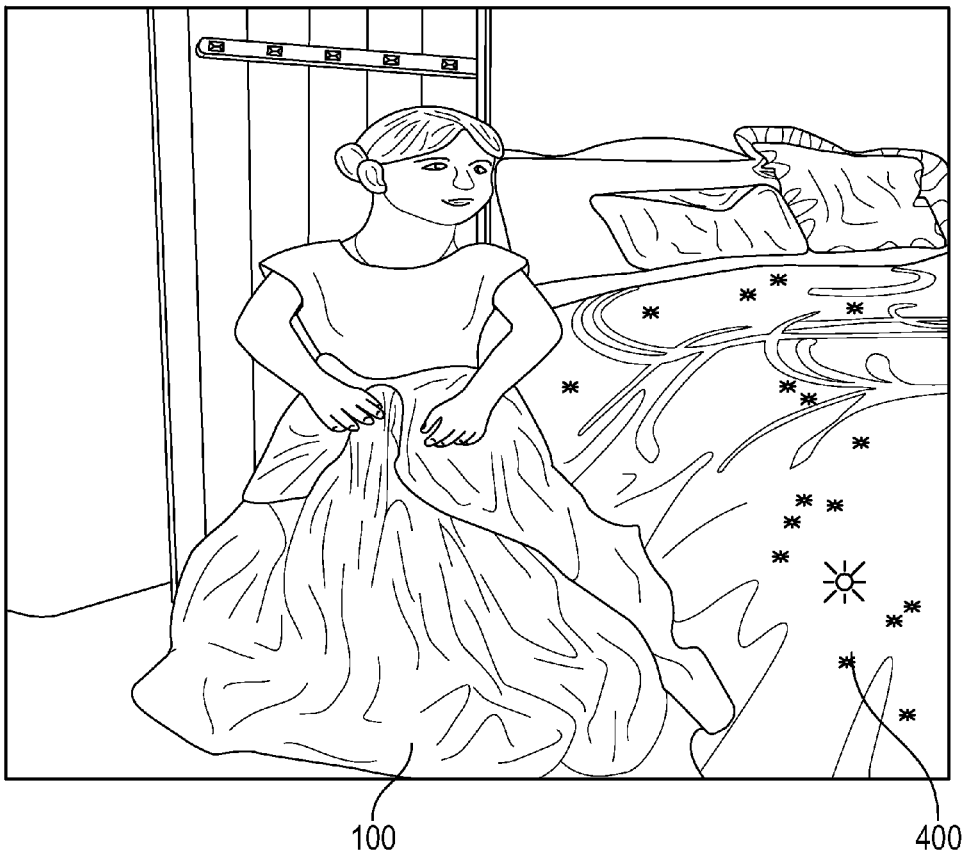

FIGS. 8 and 9, show perspective views of the detachably attached dress 100 in operation. Specifically, a user, for example, a child (here demonstrated by a mannequin), may remove the skirt by himself/herself or with assistance from her parents or guardians. For example, male snaps 110 of the dress 100 may be disengaged from the female snaps 406 of the snapped bed cover 400, and the female snaps 112 of the dress 100 may be disengaged from the male snaps 404 of the snapped bed cover 400. In one embodiment, the user may be a child. Then, the child may attach the dress around his/her waist. Further, the child may roll-play or may have story time or just enjoy the experience of wearing his/her favorite character's apparel while basking in the theme of the bedding and possibly the bedroom for lasting memories.

In another embodiment, the user is an adult and the dress is suitable to be used by the adult. The adult may remove the dress from the bed cover and may utilize it as per his or her requirement. Again, although not shown, there may be two or more dresses or other thematic articles of clothing so that the child and his/her parent or guardian can be part of the play time experience.

Figure 10:
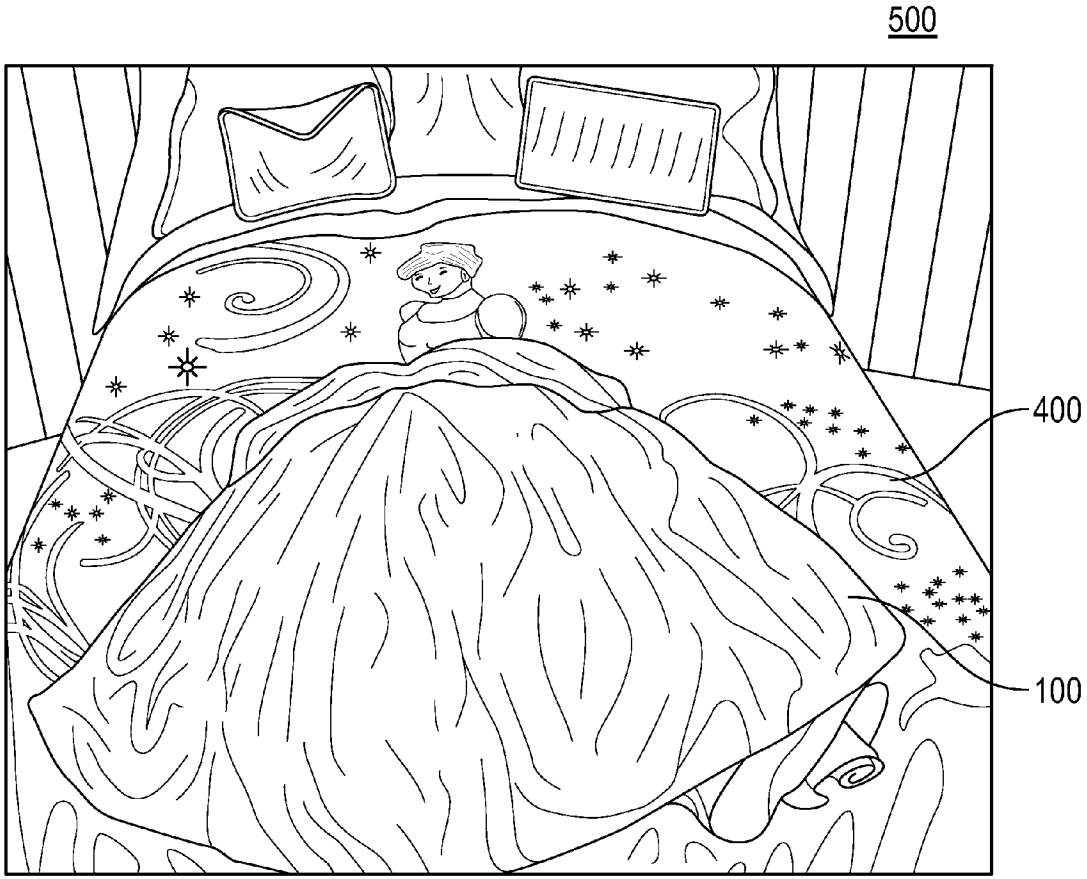
FIG. 10 depicts the dress re-integrated with the snapped bed cover depicting an embodiment of the invention.

After use, the dress 100 may be re-integrated with the snapped bed cover 400 for future use, as shown in FIG. 10. The dress may be attached or secured with the bed cover by engaging the fastening means of the dress with the fastening means of the bed cover.

Figure 11:
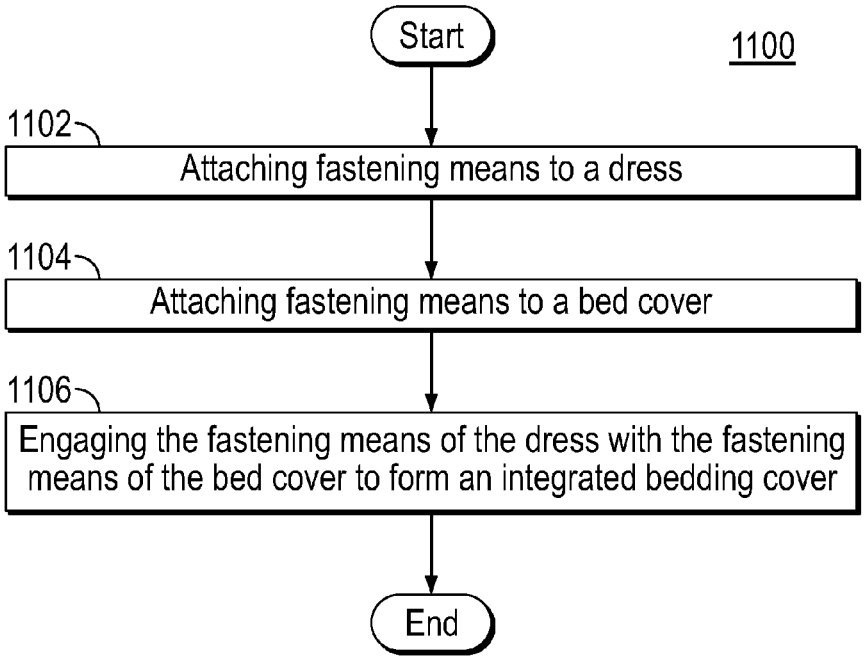
FIG. 11 depicts a method of preparing an integrated bedding cover in accordance with an embodiment of the present invention.

FIG. 11 illustrates a method 1100 for preparing an integrated bedding cover system according to an embodiment of the present invention.

In step 1102, fastening means are attached to a dress. In one embodiment of the invention, fastening means are snaps. The snaps may be made of plastic or metallic snaps or any other material suitable to be used as snapping fasteners. In an embodiment, male snaps are attached or fixed to lower portion of the dress. In another embodiment, female snaps may be attached or fixed to upper portion of the dress. In yet another embodiment, both the male snaps and the female snaps may be attached to the dress at the lower portion and/or upper portion of the dress.

In another embodiment, the fastening means of the dress may be adhesive strap, hook and loop, or any other fastening mechanism.

Further, in one embodiment, the dress is a skirt of a child. In another embodiment, the dress may be blazer of the child. In yet another embodiment, the dress may be any other dress suitable to wear by the child or any adult.

The dress may further include dress of cartoon heroes and villains, movie princesses and princes, as well as other appealing make-believe characters beloved by a user or child.

In step 1104, fastening means are attached to a bed cover. In one embodiment, the bedding cover is a comforter. In another embodiment, the bedding cover may be a blanket, quilt etc. Further, in one embodiment, the fastening means are snaps. In another embodiment, the fastening means may be adhesive strap, hook and loop, or any other fastening mechanism.

Further, the bed cover may have a particular theme coordinated with a child's bedroom furniture, window treatments, color schemes, and the like. In one embodiment, the theme may include car themes, princess themes, animal character themes, or the like. Further, in an embodiment, the theme may include cartoon heroes and villains, movie princesses and princes, as well as other appealing make-believe themes In step 1106, the fastening means of the dress are engaged with the fastening means of the bed cover to attach and secure the dress with the bed cover. In one embodiment, wherein the fastening means are snaps, the male snaps of the dress may be engaged with the female snaps of the bedding cover to prepare the integrated bedding cover system. The integrated bedding cover system may form a part of a child's bedroom.

Further, the theme of the dress may match with the theme of the bed cover. Furthermore, the theme of the integrated bedding cover system may match with a particular theme coordinated with a child's bedroom furniture, window treatments, color schemes, and the like. In one embodiment, the theme may include car themes, princess themes, animal character themes, or the like. Further, in an embodiment, the theme may include cartoon heroes and villains, movie princesses and princes, as well as other appealing make-believe themes.

Figure 12:
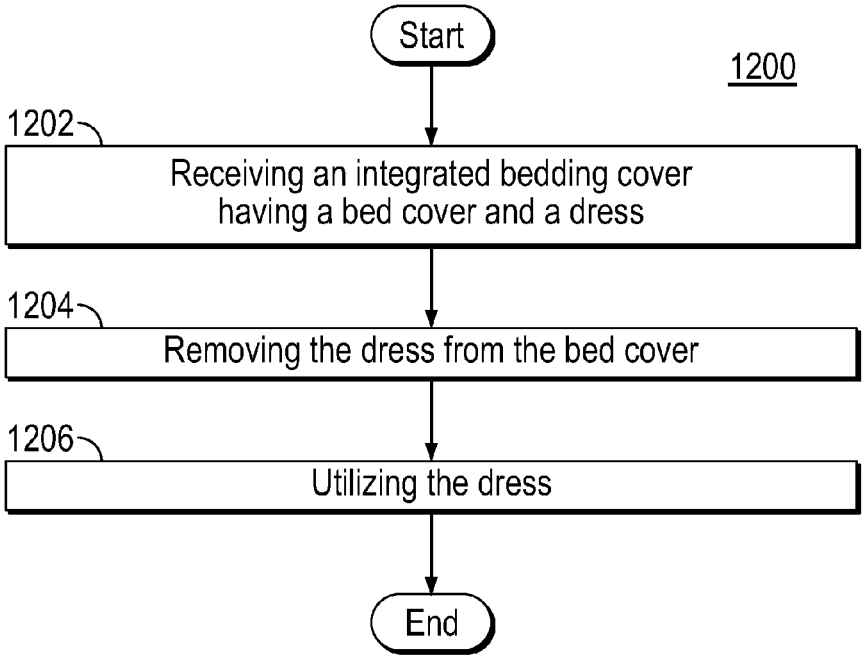
FIG. 12 depicts a method of using the integrated bedding cover in accordance with an embodiment of the present invention.

FIG. 12 illustrates a method 1200 of using an integrated bedding cover system.

In step 1202, an integrated bedding cover system is received. The integrated bedding cover system includes a bed cover and a dress. The bed cover and the dress may be attached together through a fastening means. In one embodiment, the fastening means are snaps. The dress may include male snaps and/or female snaps. Similarly, the bed cover may include female snaps and/or male snaps matching position of the snaps of the dress. The bed cover and the dress may be joined due to engagement of the male snaps and/or female snaps of the dress and with female snaps and/or male snaps of the bed cover.

In step 1204, the dress is removed from the integrated bedding cover system to separate the dress and the bed cover. In one embodiment, wherein the fastening means are snaps, the male snaps and/or female snaps of the dress may be disengaged from the female snaps and/or the male snaps to separate the bed cover and the dress.

In step 1206, the dress is utilized by a user. In one example, the dress may be apparel and wore by the user. In an embodiment, the dress is that of a famous princess. In another embodiment, the dress may be of some cartoon character or some movie character beloved by the child or hero/protagonist of the story told to the child. In yet another embodiment, the dress may any other dress suitable to wear by the child or adult.

Further, in optional step 1208 (not shown in the figure), the dress may be re-integrated with the bed cover for future use of the dress. The dress may be attached to the bed cover by engaging the fastening means of the dress with the fastening means of the bed cover.

The exemplary systems and methods of embodiments of the present invention have been described in relation to a dress and a bed cover. However, to avoid unnecessarily obscuring the present invention, the preceding description omits a number of known structures and devices. This omission is not to be construed as a limitation of the scope of the claimed invention. Specific details are set forth to provide an understanding of the present invention. It should however be appreciated that the present invention may be practiced in a variety of ways beyond the specific detail set forth herein.

Also, while the flowcharts have been discussed and illustrated in relation to a particular sequence of events, it should be appreciated that changes, additions, and omissions to this sequence can occur without materially affecting the operation of the invention.

The present invention, in various embodiments, configurations, and aspects, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, configurations, and aspects, includes providing devices and processes in the absence of items not depicted and/or described herein or in various embodiments, configurations, or aspects hereof, including in the absence of such items as may have been used in previous devices or processes, e.g., for improving performance, achieving ease and\or reducing cost of implementation.

The foregoing discussion of the present invention has been presented for purposes of illustration and description. The foregoing is not intended to limit the invention to the form or forms disclosed herein. In the foregoing Detailed Description for example, various features of the present invention are grouped together in one or more embodiments, configurations, or aspects for the purpose of streamlining the disclosure. The features of the embodiments, configurations, or aspects of the present invention may be combined in alternate embodiments, configurations, or aspects other than those discussed above. This method of disclosure is not to be interpreted as reflecting an intention that the claimed invention requires more features than are expressly recited in each claim. Rather, as the following claims reflect, inventive aspects lie in less than all features of a single foregoing disclosed embodiment, configuration, or aspect. Thus, the following claims are hereby incorporated into this Detailed Description, with each claim standing on its own as a separate preferred embodiment of the invention.

Moreover, though the description of the present invention has included description of one or more embodiments, configurations, or aspects and certain variations and modifications, other variations, combinations, and modifications are within the scope of the invention, e.g., as may be within the skill and knowledge of those in the art, after understanding the present disclosure. It is intended to obtain rights which include alternative embodiments, configurations, or aspects to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. An integrated bedding cover system comprising:

a fitted fantasy character dress comprising a plurality of connected panels, each panel having a top edge and a bottom edge;

a first plurality of fasteners, each panel including a single fastener of the first plurality of fasteners located either substantially centrally or in a corner of each panel, wherein the single fastener is proximate the bottom edge of the respective panel;

a bed cover having a second plurality of fasteners, wherein the first plurality of fasteners are placed to engage cooperatively with the second plurality of fasteners when the fitted fantasy character dress is laid flat; and wherein the first plurality of fasteners and the second plurality of fasteners together comprise common shared fasteners selected from the group consisting of snaps, hook and loop fasteners, and adhesives such that the fitted fantasy character dress is removably attached to the bed cover.

2. The integrated bedding cover system of claim 1, wherein the fitted fantasy character dress includes female snaps and the bed cover includes male snaps.

3. The integrated bedding cover system of claim 2, wherein the female snaps and the male snaps are configured to engage to attach the fitted fantasy character dress to the bed cover.

4. The integrated bedding cover system of claim 1, wherein the plurality of connected panels of the fitted fantasy character dress comprise a front panel, a side panel, and a back panel.

5. The integrated bedding cover system of claim 4, wherein the fitted fantasy character dress is a skirt of a princess.

6. A method of integrating a fitted fantasy character dress with a bed cover, the method comprising:

attaching a first plurality of fasteners to a fitted fantasy character dress comprising a plurality of connected panels, each panel having a top edge and a bottom edge, wherein a single fastener of the first plurality of fasteners is located either substantially centrally or in a corner of each panel, wherein the single fastener is proximate the bottom edge of the respective panel;

attaching a second plurality of fasteners to a bed cover, wherein the first plurality of fasteners of the fitted fantasy character dress are placed to engage cooperatively with the second plurality of fasteners when the fitted fantasy character dress is laid flat; and engaging the first plurality of fasteners of the fitted fantasy character dress and the second plurality of fasteners of the bed cover wherein the first plurality of fasteners and the second plurality of fasteners together comprise common shared fasteners selected from the group consisting of snaps, hook and loop fasteners and adhesives such that the fitted fantasy dress is removably attached to the bed cover.

7. The method of claim 6, wherein the plurality of fasteners of the fitted fantasy character dress comprises a plurality of male snaps.

8. The method of claim 7, wherein the plurality of fasteners of the bed cover comprises a plurality of female snaps.

9. The method of claim 8, further comprising engaging the plurality of male snaps with the plurality of female snaps to attach the fitted fantasy character dress with the bed cover.

10. The method of claim 6, wherein the plurality of fasteners comprises hook and loop.

11. The method of claim 6, further comprising disengaging the plurality of fasteners of the fitted fantasy character dress from the plurality of fasteners of the bed cover to remove the fitted fantasy character dress from the bed cover.

12. The method of claim 11, further comprising donning the disengaged fitted fantasy character dress on a user.

13. The method of claim 12, further comprising re-integrating the fitted fantasy character dress with the bed cover.

* * * * *